United States Patent [19]

Takata

[11] Patent Number: 4,717,077

[45] Date of Patent: Jan. 5, 1988

[54] SELF-ALIGNING COUPLER FOR FLUID TRANSMITTING CONDUITS

[75] Inventor: Harry H. Takata, Minneapolis, Minn.

[73] Assignee: Ag-Chem Equipment Co., Inc., Minneapolis, Minn.

[21] Appl. No.: 843,283

[22] Filed: Mar. 24, 1986

Related U.S. Application Data

[63] Continuation of Ser. No. 569,744, Jan. 10, 1984, abandoned, which is a continuation-in-part of Ser. No. 411,633, Aug. 26, 1982, abandoned.

[51] Int. Cl.[4] ..... B05B 15/06

[52] U.S. Cl. ..... 239/548; 239/600

[58] Field of Search ..... 239/547, 550, 600, 548; 285/93, 184, 312, 330

[56] References Cited

U.S. PATENT DOCUMENTS

| | | | |
|---|---|---|---|
| 1,177,884 | 4/1916 | Molesta et al. | 239/600 X |
| 2,033,142 | 3/1936 | Lewis | 285/312 |
| 3,124,374 | 3/1964 | Krapp | 285/312 X |
| 3,314,698 | 4/1967 | Owens | 285/312 |
| 3,447,755 | 6/1969 | Cartwright | 239/600 X |
| 3,974,964 | 8/1976 | Pearce et al. | 239/600 X |
| 4,130,247 | 12/1978 | Healy | 239/600 X |
| 4,185,781 | 1/1980 | O'Brien | 239/600 |
| 4,222,593 | 9/1980 | Lauffenburger | 285/112 X |
| 4,527,745 | 7/1985 | Butterfield et al. | 239/600 |

FOREIGN PATENT DOCUMENTS

| | | | |
|---|---|---|---|
| 151046 | 9/1920 | United Kingdom | 285/330 |

*Primary Examiner*—Andres Kashnikow
*Assistant Examiner*—Mary Beth O. Jones
*Attorney, Agent, or Firm*—Orrin M. Haugen; Thomas J. Nikolai

[57] ABSTRACT

In combination with a detachable fluid coupling arrangement for fluid transmitting conduits and including a female coupler and clamping portion and a male adaptor portion to be releasably received and retained within said female coupler portion. The female coupler portion comprises a body portion with a fluid transmitting bore formed therein, with the bore having at least one elongated alignment slot formed generally parallel to the flow axis, and with a pair of clamping cams pivotally secured to the wall of the female portion. The male adaptor portion comprises a generally tubular body having a fluid transmitting bore formed therein and with a radially extending locking lug formed along one end of the adaptor for mating engagement with the alignment slot of the female coupling portion. For purposes of strength, durability and ease of operation, a pair of alignment slots and a pair of locking lugs are provided on the coupler portions in diametrically opposed relationship, one with the other, and with the alignment slots being disposed generally at right angles from the locking cams. A leveling surface is also provided external to the male adaptor portion, and a mating nozzle may be leveled relative thereto once the coupler is leveled.

3 Claims, 5 Drawing Figures

SELF-ALIGNING COUPLER FOR FLUID TRANSMITTING CONDUITS

CROSS REFERENCE TO RELATED APPLICATION

This is a continuation of application Ser. No. 06/569,744 now abandoned, filed Jan. 10, 1984, which was a continuation-in-part of parent application Ser. No. 06/411,633, filed Aug. 26, 1982, now abandoned.

BACKGROUND OF THE INVENTION

The present invention relates generally to a detachable fluid coupling means, and more particularly to a detachable coupling system for use in combination with rigid or flexible pipe or tubing transmitting liquids from a supply source to a remote destination. One such application for which the present invention has particular application is with rigid tubing utilized in a change-over system for agricultural spray nozzles, particularly with a spray system having a number of spaced-apart nozzles and wherein different sets of such spaced-apart nozzles are utilized for crop systems requiring different application rates.

This situation is most often encountered with specialty farm operators who specialize in crop spraying and who hire out to a large number of farms to perform their spraying, when needed. Such operators thus need a spray system that is easily converted to the necessities of the different types of crops being sprayed. It is also necessary that such a system easily accomodate the alignment of the individual nozzles and maintain the alignment once it is set and as the nozzles are changed from one type to another type. In particular, proper alignment requires that all of the discharge outlets or orifices of the individual nozzles that form a part of the spray boom assembly be disposed generally normal to the surface being sprayed.

In agricultural spray applications, it is always desirable, and frequently necessary to change the nozzle size on the spray boom in order to optimize the spray of a particular solution to a particular surface and crop being treated. Such preferential application is normally utilized in the spray application of solutions or mixtures of herbicides and nutrient laden solutions such as fertilizer to the soil, and is frequently utilized in the application of insecticides to growing plants. Thus, spray application of such materials occurs in either solution form, water-wettable powder form, or slurry form. In any of the above-named spray application techniques, however, it is desirable and frequently necessary to maintain proper alignment of the discharge outlets along the length of the boom, in order to ensure that the material being applied is deposited or laid-down in a substantially uniform distribution pattern. In particular and depending upon the material being applied, the agricultural fields may require critical application rates, and excessive rates of application or inadequate rates of application may be detrimental to the crop, as well as being uneconomical.

One technique that has been found desirable for rendering spray booms adaptable to a variety of application techniques includes the utilization of the present individual, detachable spray nozzle assemblies and which are combined in individual manifold or sub-manifold assemblies as disclosed in my co-pending application Ser. No. 431,388, filed Sept. 30, 1982, and wherein each manifold assembly includes a group of 2, 3, 4 or more spaced-apart detachable nozzles of the present type. Depending upon the terrain and which is frequently other than smooth, a desired spacing between nozzles and angular disposition of each is thereby obtainable with the assurance of proper nozzle alignment and of being able to accurately and controllably apply the materials to the surface of the earth or soil being treated.

SUMMARY OF THE INVENTION

Briefly, in accordance with the present invention, a self-aligning detachable coupling arrangement is provided for fluid transmitting conduits which utilize a female coupler and clamping portion along with a male adaptor portion containing a spray nozzle and arranged to be releasably received and retained within the female portion, and wherein alignment means in the fornm of mating keys and slots or keyways between the male and female portions are utilized to preserve alignment. The self-aligning and detachable couplers of the present invention are easily and readily added to existing systems and/or combined with nozzles of different sizes and types, with ease of use being preserved with each changeover. Additionally, a positive alignment feature is added to preserve the alignment of the couplers and spray nozzles established during assembly and with this alignment being maintained during use, and which use may include drawing the devices as part of an agricultural implement over rough terrain.

Therefore, it is a primary object of the present invention to provide an improved self-aligning coupling system for use with fluid transmitting conduits, and wherein a mating pair of male and female coupling portions are provided with alignment means for preserving the alignment that is established during assembly during use of the device, without adversely affecting the coupling operation.

It is yet a further object of the present invention to provide an improved self-aligning coupling system for fluid transmitting conduits, wherein a female coupler and clamping portion is used in combination with a male adaptor portion, and wherein the female coupling portion includes an alignment slot formed therein, and with the male adaptor portion including a radially extending spline, key or ear portion adapted to extend into the alignment slot during initial coupling and use of the system.

It is yet a further object of the present invention to provide an improved self-aligning coupler system for fluid transmitting conduits, and wherein a positive camlock arrangement is provided which positively seats the male coupler portion against a gasket retained within the female coupler and clamping portion.

It is still further the object of the present invention to provide an improved self-aligning coupler system wherein the male and female coupler portions and a spray nozzle may be individually aligned relative to the surface being sprayed.

Other and further objects of the present invention will become apparent to those skilled in the art upon a study of the following specification, appended claims, and accompanying drawing.

DESCRIPTION OF THE PREFERRED EMBODIMENT

Figure 1:
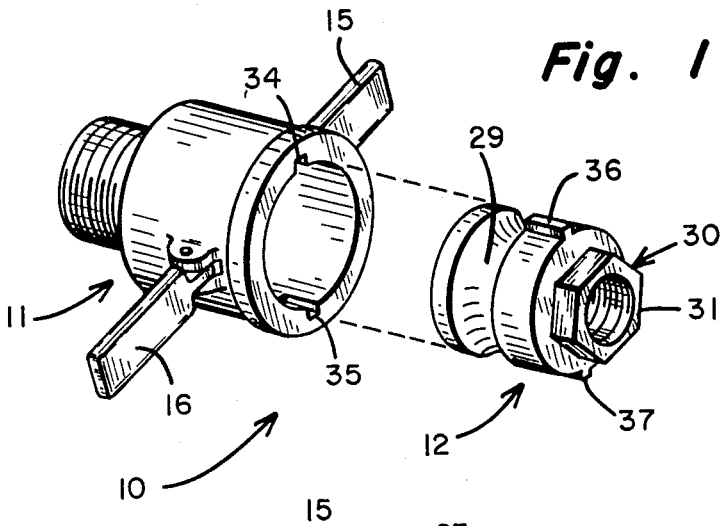
FIG. 1 is a perspective view of the coupling means of the present invention in detached configuration, and showing the female coupler and clamping portion with the locking cams in open disposition.

In accordance with the preferred embodiment of the present invention, and with particular attention being directed to FIG. 1 of the drawing, the coupling means generally designated 10 includes a female coupler and clamping portion generally designated 11 along with a male adaptor portion generally designated 12. The female coupler and clamping portion is adapted to releasably retain the male adaptor portion therewithin, and with the female portion being provided with a pair of clamping members which are pivotally secured to the walls thereof, and shown at 15 and 16. These clamping members will be more fully described hereinafter.

Figure 2:
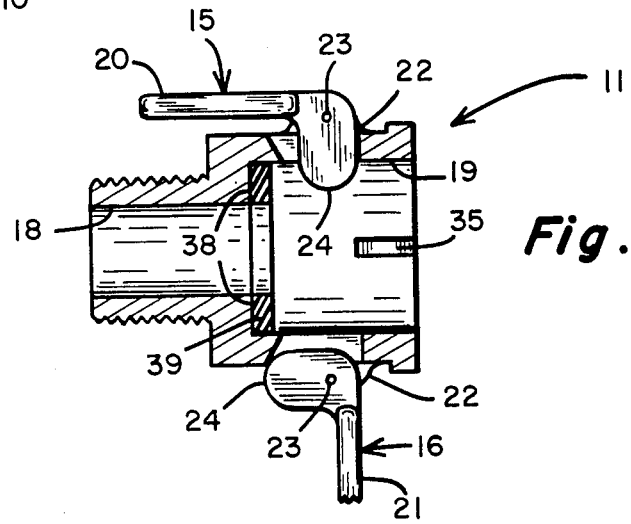
FIG. 2 is a sectional view of the female coupler and clamping portion taken generally diametrically thereof, and showing one of the locking cams in closed disposition, and with the other in open disposition.

With attention continuing to FIG. 1, and with attention also being directed to FIG. 2, the female coupler and clamping portion 11 is provided with an internal bore as at 18, along with a counterbore portion at 19. The clamping and camming portions 15 and 16 include arms 20 and 21 respectively, with each of the arms being pivotally coupled or secured to the body portion of female coupling and clamping member 11 through a pair of parallelly disposed ears such as at 22–22. A pin extends through the ears 22–22 as at 23, with the pin providing a pivotal mounting point for camming members 15 and 16. The inner portion of the camming members are each provided with cam surfaces 24 for engaging the annular groove formed in male portion 12.

Figure 3:
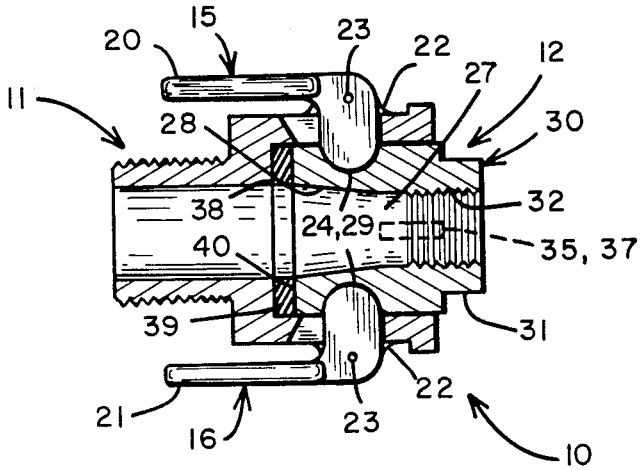
FIG. 3 is a sectional view of the coupling means of the present invention in mated locked disposition.

With continued attention being directed to FIG. 1, and with further attention being directed to FIG. 3, male adaptor portion 12 is provided with a bore as at 27, with the bore being tapered pursuant to the requirements of the system as at 28. An annular groove is provided about the periphery of male adaptor 12 as at 29, with groove 29 being adapted to mate with and engage cam portions 24 of locking members 15 and 16. For convenience in installation, the distal end 30 of male portion 12 is formed with a hexagonal configuration, as at 31, for purposes of threadably engaging the internal threads 32 with mating threads of a pipe, conduit, or the like. In actual practice, and depending upon the size of the individual coupling means, the hexagonal configuration as at 31 may be as large as the diameter of the male portion, and in effect inscribed therewithin.

In order to preserve alignment between the male and female portions of the coupling means of the present invention, the female coupler and clamping portion 11 is provided with a pair of radially extending slots or grooves as at 34 and 35, while male portion 12 is provided with radially extending splines, ears or lugs as at 36 and 37. During assembly of the system in which the coupling means of the present invention is to be utilized, the operator is able to rotate male adaptor portion 12 by means of the hexagonal head portion as at 30, and by virtue of the dual-alignment arrangement of the keyways 34 and 35 and keys 36 and 37, only a one-quarter revolution or less will be required to maintain the degree of torque on the devices without subjecting the devices to over-tightening. Once the individual coupling elements 11 and 12 have been engaged with the mating pipe, tubing, conduit, or the like, this alignment, which is established during assembly, is maintained during normal operation, and a quick-change may be achieved without requiring disassembly of any of the pre-fit components of the system.

Figure 4:
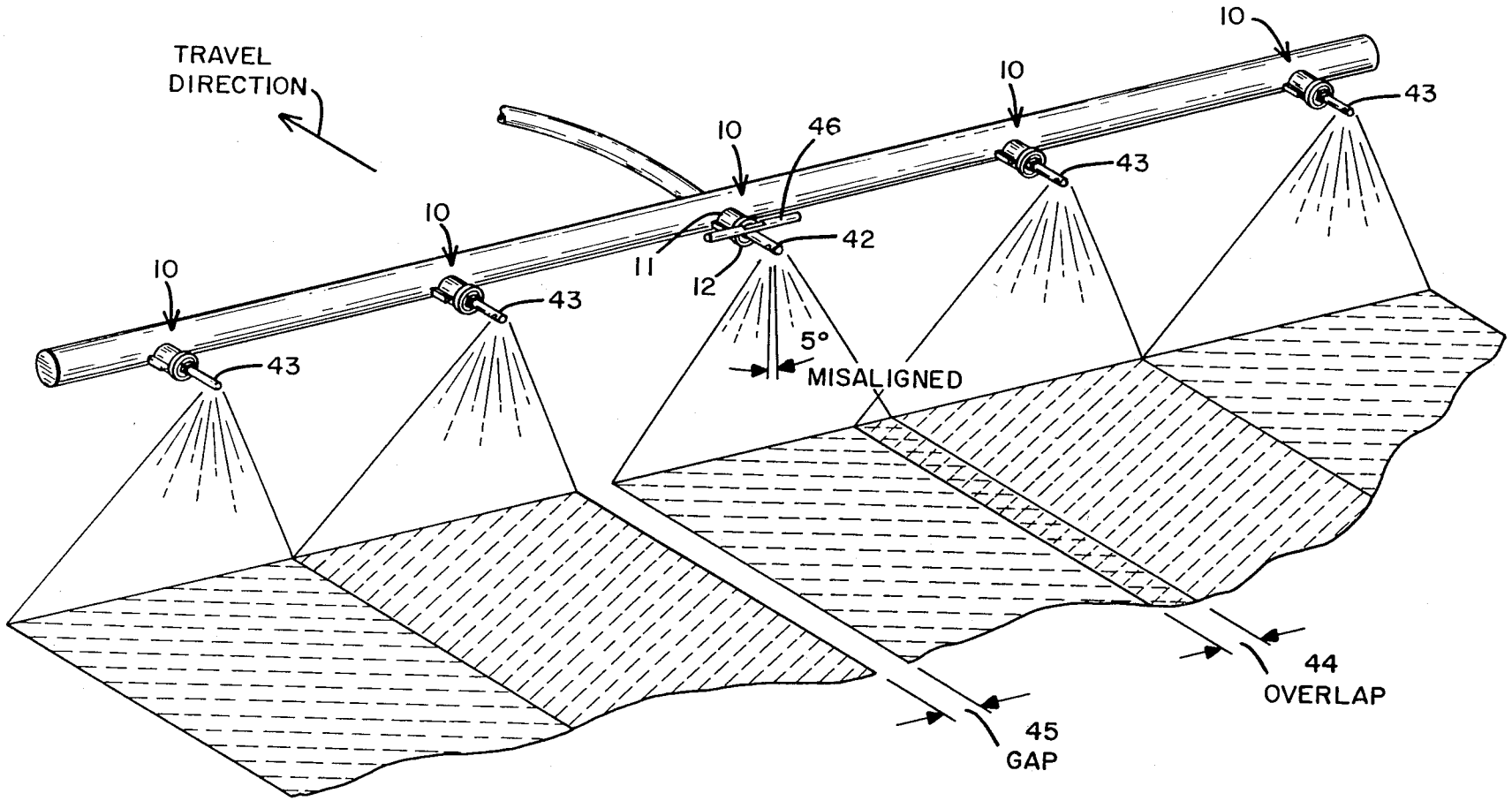
FIG. 4 is a perspective view of a portion of a system incorporating the coupling arrangement of the present invention, and illustrating the device in use with a spray boom arrangement, and further illustrating the manner in which the individual male nozzle portions, for example, may be aligned.
Figure 5:
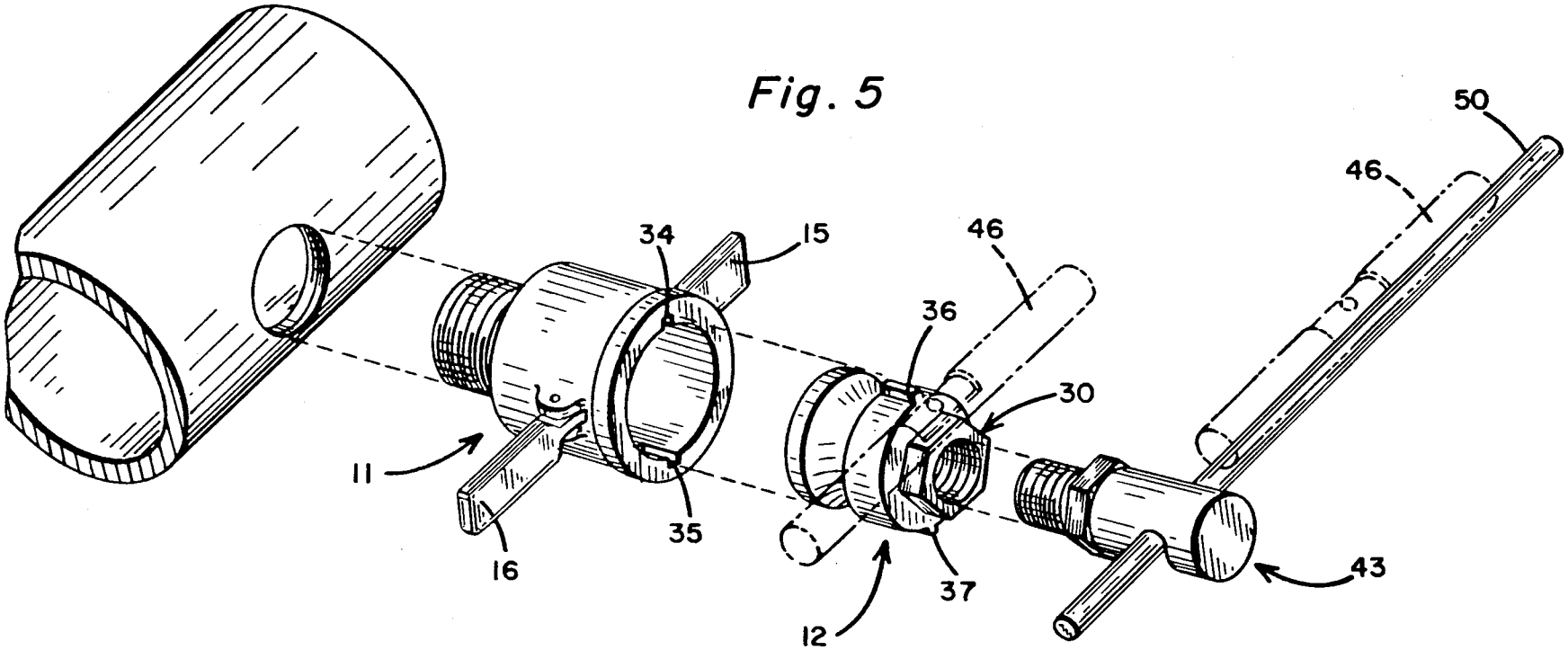
FIG. 5 is a perspective view, like FIG. 1, showing in greater detail the leveling sequence employed in aligning the couplers and nozzles relative to a spray boom.

In order to preserve fluid integrity through the system, a gasket seat is provided at the juncture of the bore 18 and counterbore 19, along shoulder or step 38. Gasket material is appropriately provided as at 39 for planar contact surface 40. In certain applications, it may be desirable to provide a flat, washer-like spray orifice in the assembly, generally positioned in back of the gasket. Alternatively, a spray nozzle 43 may be threadably secured at the internal threads 32 and which may comprise a cylindrically shaped member having a bore formed therethrough relative to a recess cut into the member so that the fluid flow is directed downwardly upon striking an inner surface of the recess, opposed to the bore. In the embodiment of FIGS. 4 and 5, the nozzle 43 comprises a Flood Jet® nozzle as sold by Spraying Systems Co., Wheaton, Ill. While the slots or keyways have been shown to be disposed within the female portion 11, it will, of course, be appreciated that slots or keyways may be formed in the male coupler portion as well, however, for purposes of fluid and system integrity, the better choice is to mount the keys or ears in the male portion 12.

In performing the attachment operation, the operator will move the camming arms 15 and 16 to the open position as illustrated in FIG. 1, and thereafter insert the coupling portion 12 into appropriate position, as illustrated in FIG. 3. At that point, the locking arms 15 and 16 are moved radially about their respective pivot points, thereby causing the cam surfaces 24—24 to engage the annular groove 29. This camming action forces or urges the male portion 12 into appropriate fluid-tight contact with female portion 11 by virtue of the seating engagement between gasket 39 and surfaces 38 and 40.

In actual operation, and with particular attention being directed to FIG. 4, a spray boom is illustrated having a plurality of nozzles 43 attached thereto, and wherein the middle flooding nozzle 42 is shown as being misaligned relative to the other nozzles 43. This misalignment, for example as low as 5°, can cause considerable overlap in the spray pattern with an adjacent nozzle 43 as at 44, along with a gap at the other adjacent nozzle 43 as shown at 45. Properly aligned nozzles will, in this instance, however provide for appropriate flooding or spraying of the surface along a pattern with an appropriate elimination of overlap and gaps.

With continuing reference to FIG. 4 and also referring to FIG. 5 and in order to achieve a proper alignment between each coupler 10 and nozzle 43, a spirit-level 46 is utilized. The spirit-level 46 may be either of the pocket type or string-line type. During the leveling of each coupler 10, the level 46 is placed on the upper flat surface of the distal end 30 of each male portion 12 and used to adjust the coupler 10 to a level condition. That is, upon threadably securing a female coupling portion 11 and a contained male coupling portion 12 to the spray boom, the combined coupling portions 11 and 12 are leveled relative to the ground (assuming the spray boom is level) with the arms 20 and 21 parallel to the boom. Upon thereafter detaching and reattaching the male coupler portion 12, an operator is assured of the proper alignment between the coupler portions 11 and 12 relative to the boom and the ground.

Next and with particular attention to FIG. 5, the nozzle 43 is leveled relative to the leveled coupler 10 by placing a leveling rod 50 or straight-edge in the deflector region 51 of the nozzle 43, while leveling the rod 50 via the level 46. This step then ensuring the proper alignment of the nozzle 43 to the coupler 10 and ground. Upon once aligning all of the nozzles 43 that might be interchanged in the female coupler portions 11, an operator is thereafter assured of proper nozzle alignment as the nozzles 43 are changed from one crop type to another crop type, etc. It is to be recognized further that the present coupler system provides for greater accuracy and economics of time and money than achieved by fixed-type couplers and/or "eye-balling" each nozzle 43's alignment.

While the present invention has been described with respect to its preferred embodiment, it is to be recognized that modifications may be made thereto. To the extent such modifications are the equivalent of the invention disclosed and not without the scope of changes that might be suggested to those of skill in the art, it is contemplated that the following claims shall be interpretted to include all such equivalents.

What is claimed is:

1. In a fluid supply system having a plurality of detachable fluid transmitting conduits and including a female coupler portion and a male adaptor portion to be releasably received and retained within said female coupler portion, said supply system being further characterized in that:

(a) said female coupler portion comprises a body portion having a male threaded end for coupling to a supply manifold and a bore formed therein with a generally horizontally disposed flow axis extending therethrough, and with said bore having a pair of diametrically opposed elongated alignment slots formed generally parallel to the flow axis thereof, a pair of clamping members pivotally secured to the walls of said female coupling portion and arranged in generally diametrically opposed relationship along said bore and with each clamping member being disposed generally at right angles to one of said alignment slots;

(b) said pivotal clamping members each having a cam locking ear portion adapted to extend from said body portion radially inwardly into said bore and with said cam locking ear portions having a generally arcuate locking surface;

(c) said male adaptor portion comprising a generally tubular body with a proximal end and a distal end and having a bore formed therethrough, said bore being in communication with one of said plurality of detachable transmitting conduits and with said bore being in alignment with and generally coaxial with the bore of said female coupling portion, a pair of locking lugs extending generally radially of said bore adjacent the proximal end of said male adaptor portion and arranged to mate with said alignment slots, and an elongated annular groove formed adjacent said proximal end, said annular groove being adapted to receive the camming ears of said pivotal clamping members therewithin; and (d) a flat peripheral reference alignment surface arranged along the distal end and normal to said flow axis and generally normal to a line extending along the diameter of said male adaptor bore and between said locking lugs for accommodating level indicating devices disposed in flat surface-to-surface contact therewith.

2. An improved spray system for applying liquid materials in a controlled fashion via a plurality of spray systems, wherein the improvement comprises:

(a) a supply manifold having a plurality of spray nozzles spaced therealong, each producing a spray stream of a predetermined shape and each detachably mounted thereto in a level adjustable, self-aligning, quick-disconnect fashion;

(b) each of said spray nozzles comprising detachable coupling means including a female coupler and clamping portion threadably mounted to said manifold and a male adaptor portion formed to be releasably received and retained within said female coupler portion, said coupling means being further characterized in that:

(1) each of said female coupler portions comprises a body portion having a bore formed therein with a generally horizontally disposed flow axis extending therethrough and with said bore having a pair of diametrically opposed elongated alignment slots formed generally parallel to the flow axis thereof, a pair of clamping members pivotally secured to the walls of said body portion and arranged in generally diametrically opposed relationship along said bore and said alignment slots being radially displaced at approximately 90° from said clamping members;

(2) said pivotal clamping members each having a cam locking ear portion adapted to extend from said body portion radially inwardly into said bore and with said cam locking ear portions having a generally arcuate locking surface for entry into said bore;

(3) said male adaptor portion comprising a generally tubular body having an outwardly projecting end, a bore formed within said male adaptor and with said bore arranged to extend generally coaxially with the bore of said female coupling portion, a pair of diametrically opposed locking lugs arranged transversely to said pivotal clamping members and extending radially of said bore adjacent the proximal end of said male coupling portion and arranged to mate with said alignment slots and an annular groove formed therealong to receive the camming ears of said pivotal clamping members therewithin and with said alignment slots being in alignment with said locking lugs;

(4) a generally flat reference surface for arcuate alignment of said male adaptor portion being arranged along said outwardly projecting end and generally parallel to a line extending between said annular groove for accommodating level indicating devices while being positioned and disposed in flat surface-to-surface contact therewith, thereby permitting the arcuate leveling of said male adaptor portion relative to said manifold, and (5) each of said plurality of spray nozzles being secured coaxially with said bore of said male adaptor portion and having means for independently leveling said spray nozzles relative to said manifold upon being coupled thereto, said leveled alignment thereby being preserved after repeated couplings of said male adaptor portions to said female coupler portions.

3. The coupling means as defined in claim 2 being particularly characterized in that each of said female coupling portions is provided with a counterbore therewithin, and wherein a gasket is disposed at the base of said counterbore for mating with one of said male adaptor portions.

* * * * *